United States Patent [19]

Broeksteeg

[11] Patent Number: 5,066,236

[45] Date of Patent: Nov. 19, 1991

[54] IMPEDANCE MATCHED BACKPLANE CONNECTOR

[75] Inventor: Johannes M. Broeksteeg, Ag Oss, Netherlands

[73] Assignee: AMP Incorporated, Harrisburg, Pa.

[21] Appl. No.: 584,672

[22] Filed: Sep. 19, 1990

[30] Foreign Application Priority Data

Oct. 10, 1989 [GB] United Kingdom ..... 8922765
Oct. 10, 1989 [GB] United Kingdom ..... 8922781

[51] Int. Cl.[5] ..... H01R 13/648

[52] U.S. Cl. ..... 439/79; 439/108; 439/608; 439/680

[58] Field of Search ..... 439/108, 79, 81, 95, 439/65, 685, 695, 701, 607, 608, 609, 680, 681

[56] References Cited

U.S. PATENT DOCUMENTS

| | | | |
|---|---|---|---|
| 3,456,231 | 7/1969 | Paulus et al. | 339/60 |
| 4,070,084 | 1/1978 | Hutchison | 439/608 |
| 4,451,107 | 5/1984 | Dola et al. | 439/65 |
| 4,558,917 | 12/1985 | Kamono et al. | 339/143 |
| 4,571,014 | 2/1986 | Robin et al. | 339/14 |
| 4,632,476 | 12/1986 | Schell | 339/14 |
| 4,686,607 | 8/1987 | Johnson | 439/81 |
| 4,705,332 | 11/1987 | Sadigh-Behzadi | 439/69 |
| 4,762,500 | 8/1988 | Dola et al. | 439/79 |
| 4,806,107 | 2/1989 | Arnold et al. | 439/79 |
| 4,836,791 | 6/1989 | Grabbe et al. | 439/81 |
| 4,846,727 | 7/1989 | Glover et al. | 439/108 |
| 4,861,272 | 8/1989 | Clark | 439/79 |
| 4,865,562 | 9/1989 | Burg et al. | 439/885 |
| 4,900,258 | 2/1990 | Hnatuck et al. | 439/79 |
| 4,914,062 | 4/1990 | Voltz | 439/608 |
| 4,952,172 | 8/1990 | Barkus et al. | 439/79 |
| 4,975,084 | 12/1990 | Fedder et al. | 439/608 |

*Primary Examiner*—Gary F. Paumen
*Assistant Examiner*—Kevin J. Carroll
*Attorney, Agent, or Firm*—Eric J. Groen

[57] ABSTRACT

An electrical connector is shown which is mountable to a printed circuit board (230) which includes a plurality of insulating housings (4). The vertical row of terminals is formed as a subassembly (60) where the terminals (72–75) are integrally molded within an insert 82 of dielectric material. The lengths of the sections (72*a*, 73*a*, 74*a*, 75*a*) of the terminals (72–75) which are within the molded insert (82) vary to alter the impedance of the terminals 72–75, thereby matching the overall impedance of the terminals (72–75). Cross-talk shield members (180') are insertable into the rear of the connector housing (4) to shield adjacent vertical rows of terminals from cross-talk. Upper (100) and lower (100') shield members are insertable over the assembly to shield the assembly from EMI/RFI.

36 Claims, 12 Drawing Sheets

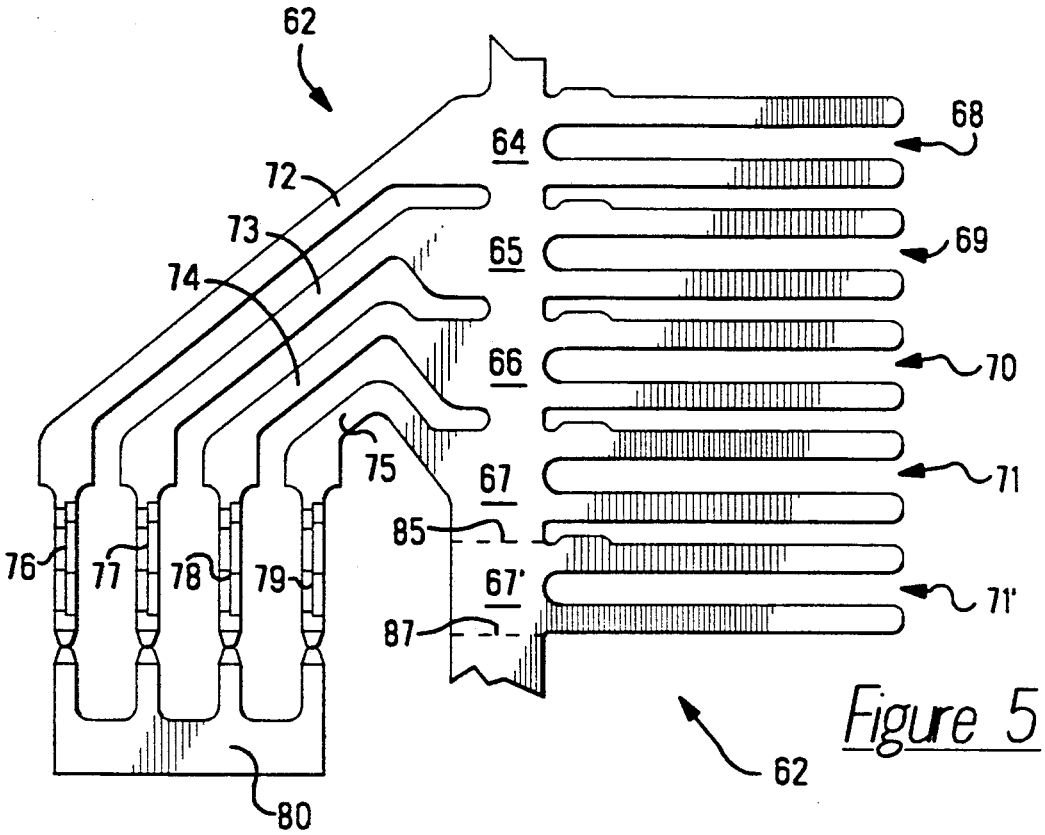
Figure 5
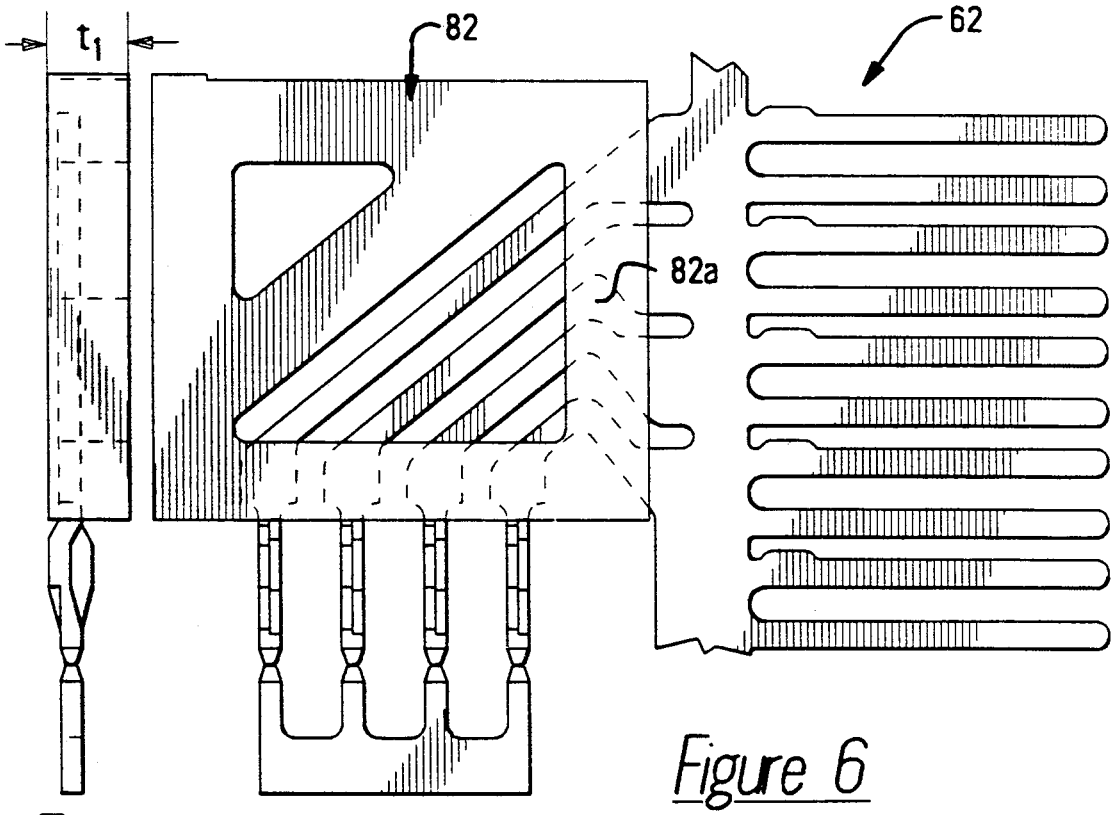
Figure 6
Figure 7

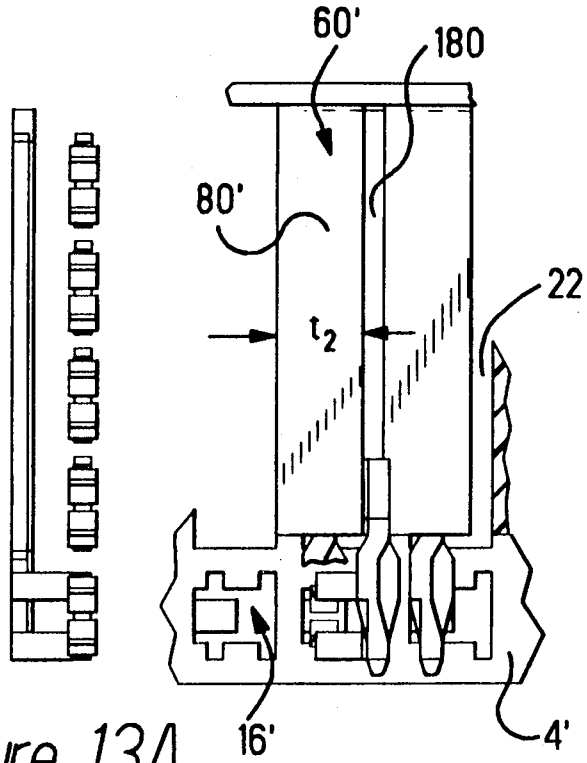
Figure 13B
Figure 13A
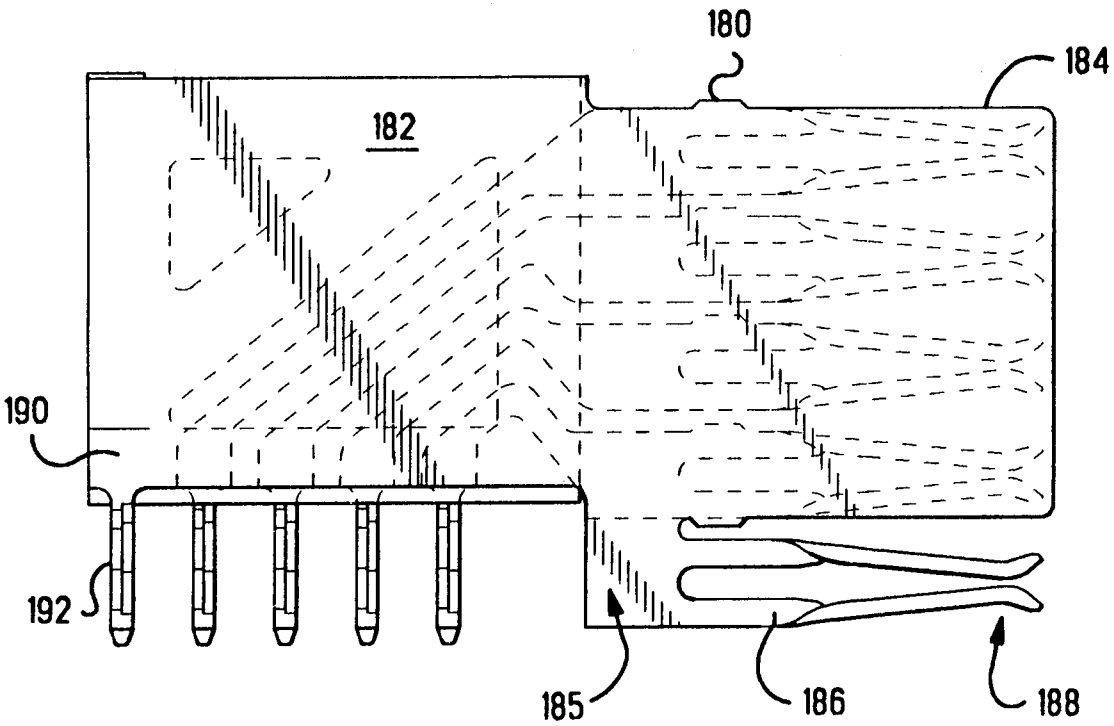
Figure 13

IMPEDANCE MATCHED BACKPLANE CONNECTOR

FIELD OF THE INVENTION

The present invention relates to an electrical connector assembly for printed circuit boards and more particularly to a high speed impedance matched backplane connector.

BACKGROUND OF THE INVENTION

In current electronic circuits, the use of increasingly higher speed switching signals has necessitated control of impedance for signal transmission. In an attempt to provide an impedance matched connector, a coaxial type connector as described in U.S. Pat. No. 4,451,107, was devised. Although some of the above mentioned problems were solved, other serious problems arose. At high speed transmission, the right angle of the terminals causes reflection of the signals limiting the effectiveness of the connector at high speed transmission.

The manufacturing of the connector described in U.S. Pat. No. 4,451,107 is also made impractical by the manufacturing process of die casting the metal housing, injection molding of nylon sleeve, casting the terminals through the nylon sleeves in the housing. This process of manufacturing is very difficult to control and can lead to faulty connections. Therefore, the configuration of the invention of the above cited reference is impractical for many reasons.

In another attempt to design an impedance control connector, as shown in U.S. Pat. No. 4,836,791, a mother-daughter board connector is disclosed and shows a motherboard connector 10 and a right angle connector or plug connector 8 which is interconnectable to the motherboard 10. The motherboard 10 includes a plurality of tab assemblies 20. A right angled connector 8 includes insulative housing 22 having a plurality of apertures 12 therethrough. In order to control the impedance of the terminals in a right angled connector, since the signal path distances must differ, a dielectric coil spring 56 or dielectric member 49 is placed over the terminals 18. The selection of the material and configuration of the coil springs 56 and dielectric 49 can alter the speed at which the signals propagate through the terminals. Since the length of the terminals vary, the dielectric constant for the shorter terminals is higher, slowing the signals down somewhat, whereas the longer terminals have a lower dielectric constant to increase the speed of the signal relative to the shorter signals. While in theory the above mentioned design accomplishes the desirability of matching the impedance between the right angled terminals, the connector is somewhat complicated and thereby difficult and costly to manufacture.

SUMMARY OF THE INVENTION

The object of the invention then is to provide for an impedance matched electrical connector which is easily manufacturable.

The above mentioned object was accomplished by providing a controlled impedance right angle electrical connector assembly where an insulating housing has a front mating face and a rear face. At least one terminal assembly is included where the subassembly includes a stamped lead frame including a plurality of edge stamped right angle contacts where the contacts each include a printed circuit board interconnection section, an intermediate section and a mating contact section, where each consecutive intermediate section increases in length from the prior and adjacent contact. An insert is overmolded over the lead frame which encapsulates at least a portion of the lead frame in an insulative material leaving the remainder of the intermediate portion exposed to the air. The combination of the encapsulation in the dielectric material, and exposure to air balances the impedance of the plurality of contacts.

It too is important to provide for an easily manufactured connector with the availability for other options such as exterior RFI/EMI shielding, keying and the like without complicating the system.

The object of the invention then is to provide for a shielded and impedance matched electrical connector which is easily manufacturable.

Another object is to provided for optional exterior shielding and for optional shielding between the contacts to prevent crosstalk.

The above mentioned objectives were accomplished by designing an electrical connector assembly comprising an insulating housing having a front mating face and a terminal receiving face. The front mating face has an array of apertures aligned in a plurality of vertical rows for the receipt of a plurality of mating contacts. A terminal subassembly having a plurality of electrical terminals is encapsulated within a molded web, the electrical terminals comprises a mating contact portion and a conductor connecting portion. Each of the terminals is vertically aligned one above the other, wherein a plurality of terminal subassemblies are insertable into the connector housing to position the mating contact portions adjacent to a rear side of the apertures.

By so designing the connector assembly, the daughterboard connector can accommodate a plurality of applications and configurations. This connector assembly can be used in an unshielded configuration, it can be used in a fully shielded (EMI/RFI) configuration, and it can be used in a fully shielded configuration and include shield members between each vertical row of electrical terminals to prevent cross talk between adjacent terminals in adjacent vertical rows.

BRIEF DESCRIPTION OF THE DRAWINGS

With reference now to the drawings, a preferred embodiment of the invention will be shown where:

FIG. 5 is a plan view of the stamped blank of the terminal subassembly;

FIG. 6 is a view similar to that of FIG. 5 showing the molded web over the terminal lead frame;

FIG. 7 is an end view of the subassembly of FIG. 6;

FIG. 13 is a plan view of the cross talk shield of FIG. 14 with one terminal subassembly in phantom;

FIG. 13A is a front plan view of FIG. 13;

FIG. 13B is a rear cross-sectional view showing the terminal subassembly and cross talk shield of FIG. 13 inserted in a rear housing module;

DETAILED DESCRIPTION OF THE INVENTION

Figure 1:
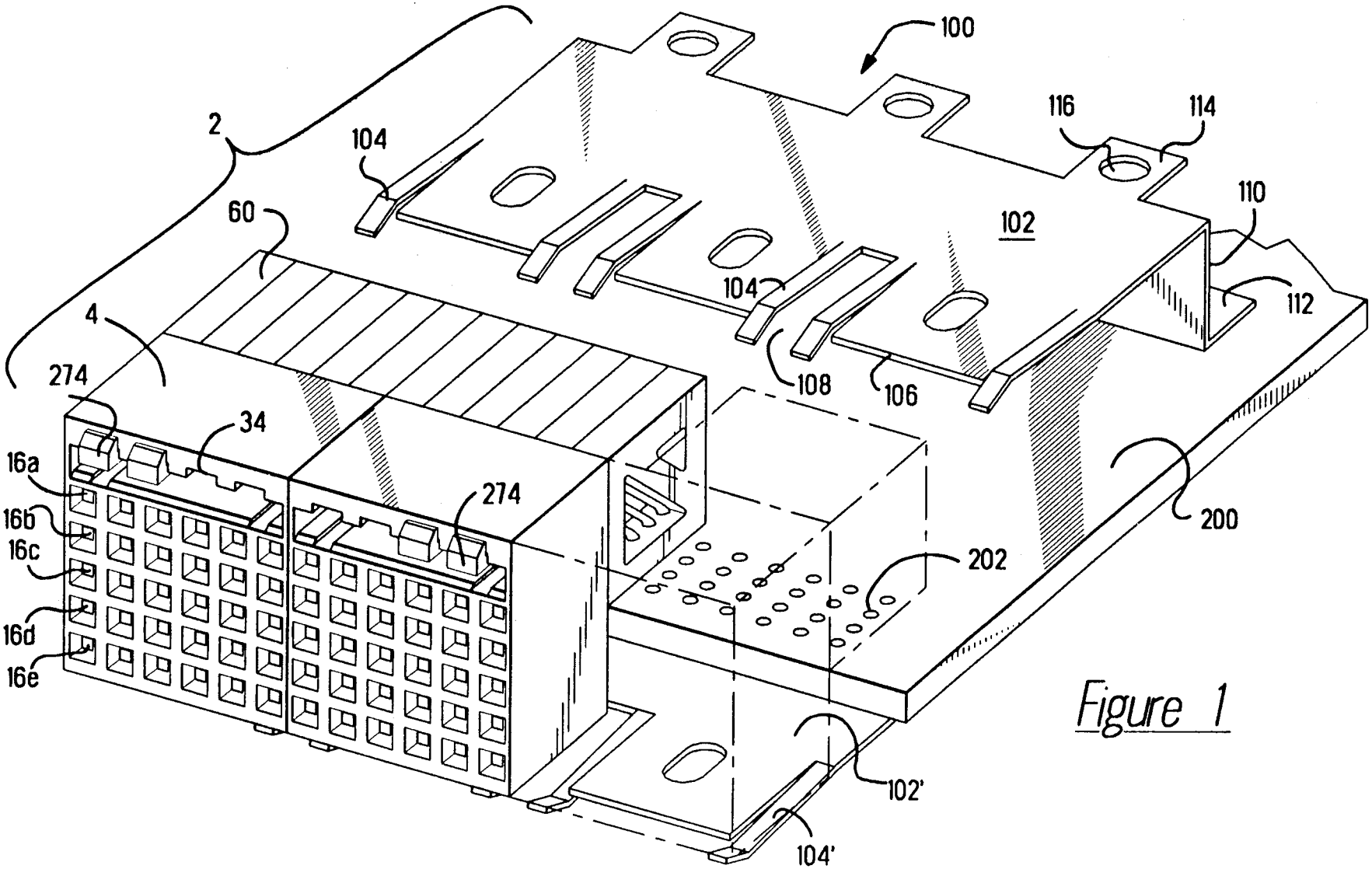
FIG. 1 is a perspective view of the daughterboard connector of the subject invention.
Figure 10:
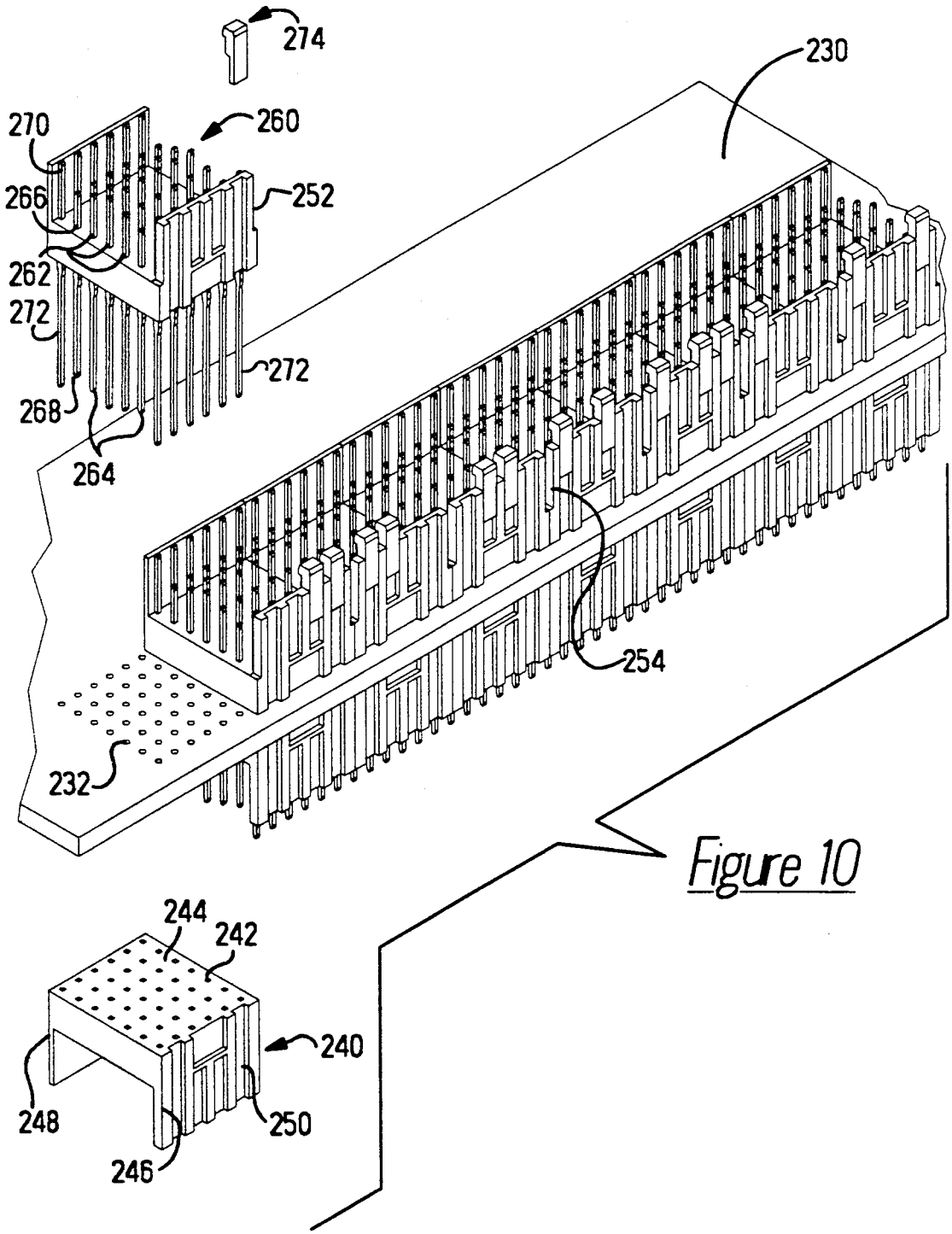
FIG. 10 is a isometric view of the post header.
Figure 11:
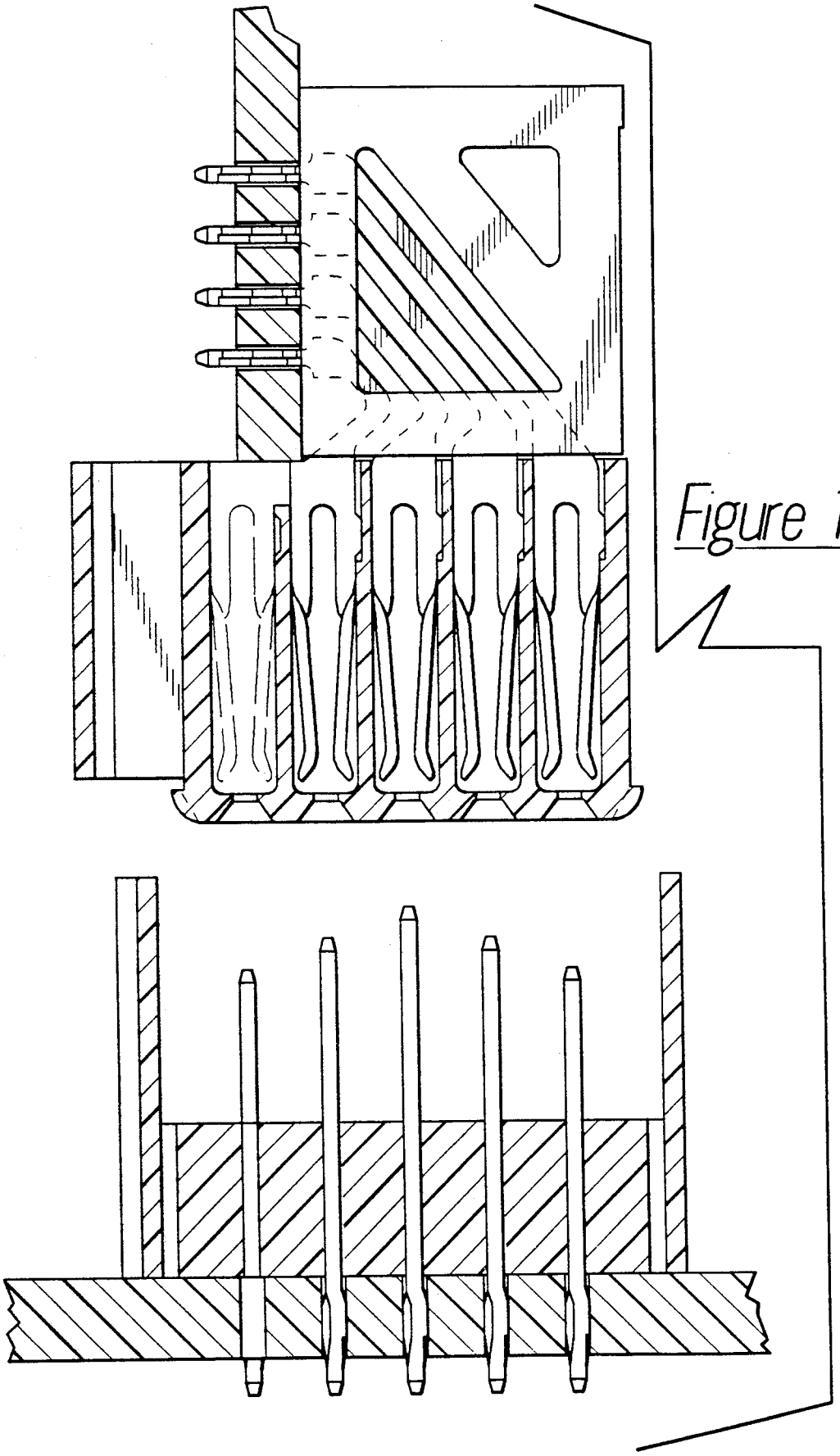
FIG. 11 is an alternate embodiment of the above mentioned invention.

With reference first to FIG. 1 and 10, the invention includes a daughter board connection system 2 which is interconnectable with: a post header such as that shown in FIG. 10. The electrical connection system 2 of the present invention includes a plurality of housing modules 4 abutted one against the other to form a connection system. It should be understood that while only two such modules are shown in FIG. 1, this is for clarity only. Any number of modules can be used and it is anticipated that a typical connection system would include 8-10 modules.

Figure 2:
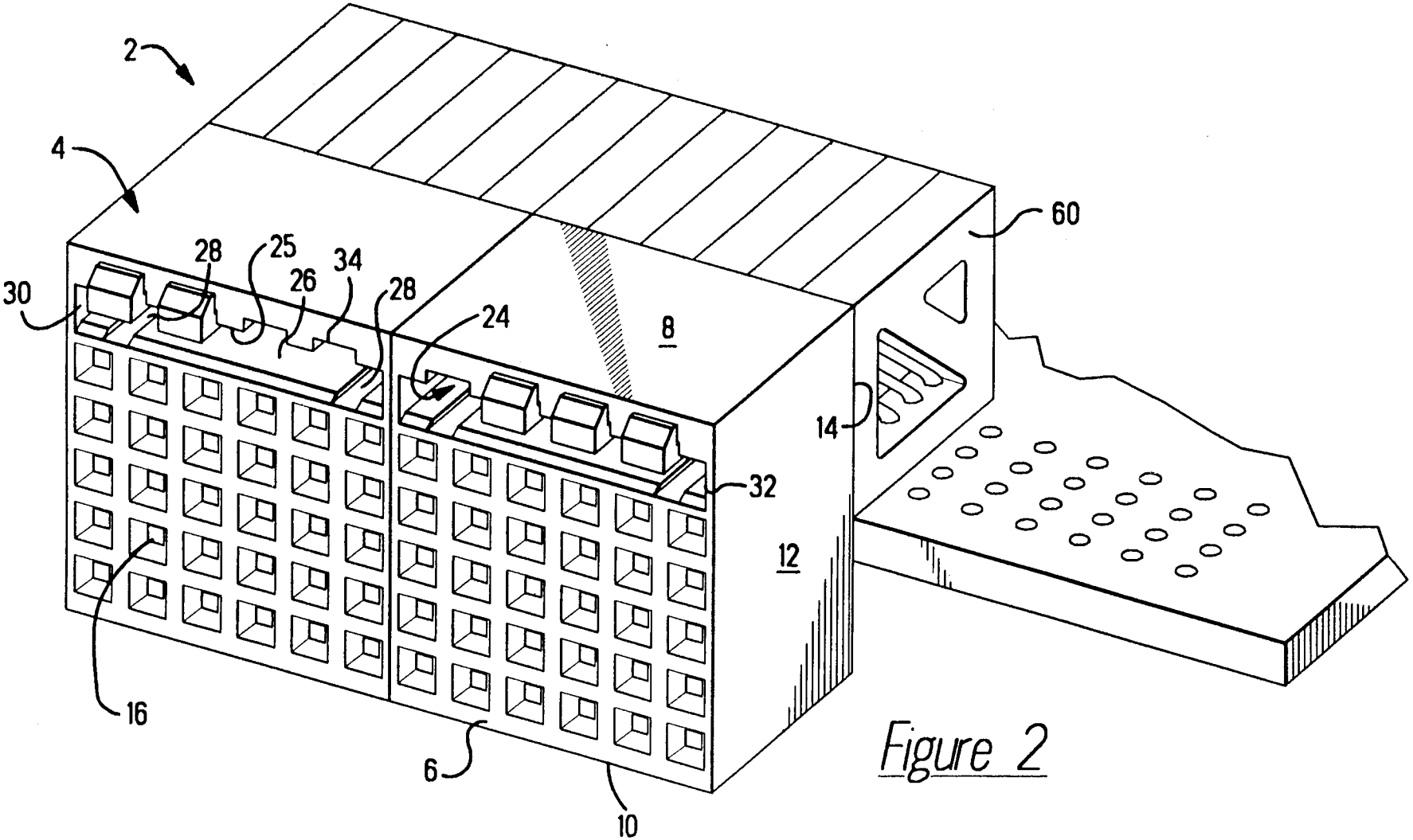
FIG. 2 is an enlarged view of two of the housing modules of the daughterboard connector shown in FIG. 1.
Figure 3:
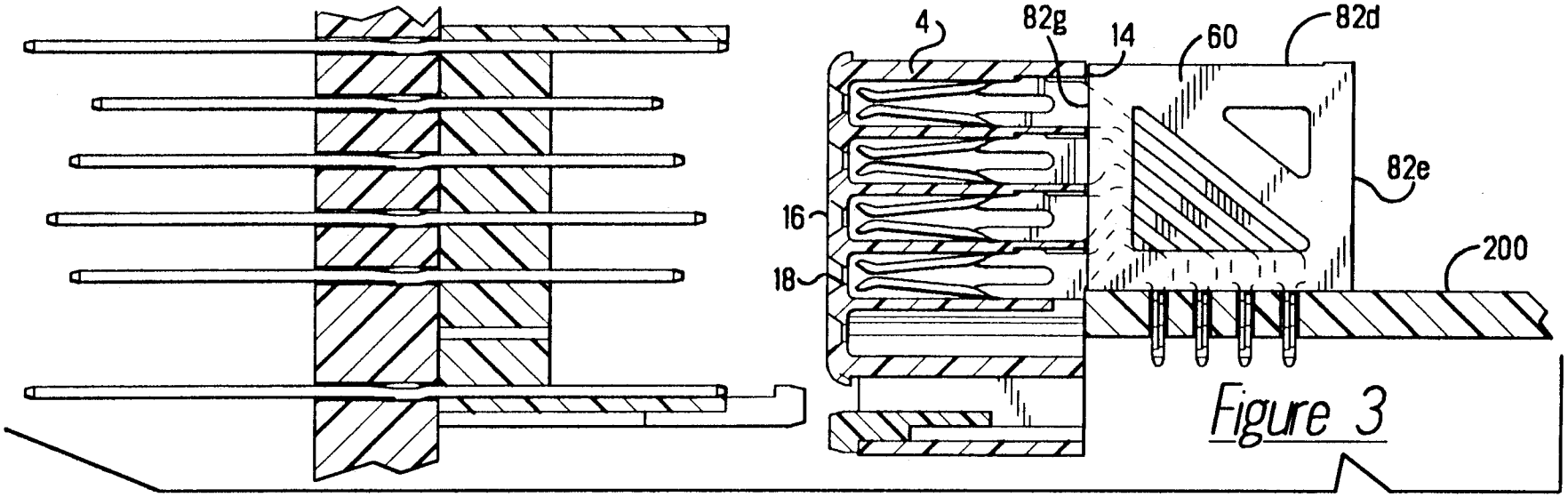
FIG. 3 is a cross-sectional view through the daughterboard connector of FIGS. 1 and 2 poised for interconnection with the post header.

With reference now to FIG. 2, each of the modules 4 include a front mating face 6 having a plurality of pin receiving apertures 16, a top wall 8, a bottom wall 10, sidewalls 12, and a rearwall 14. With reference to FIG. 3, the pin receiving apertures 16 includes a narrow through hole 18.

Figure 9A:
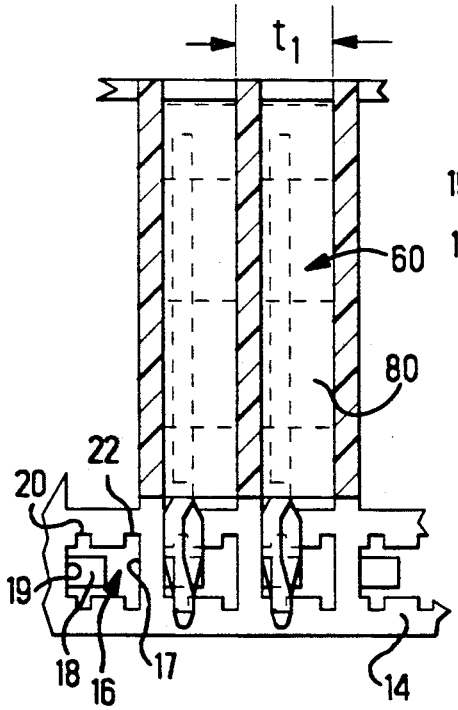
FIG. 9A is a rear cross-sectional view of the terminal subassembly as inserted within the rear face of the housing module.
Figure 9:
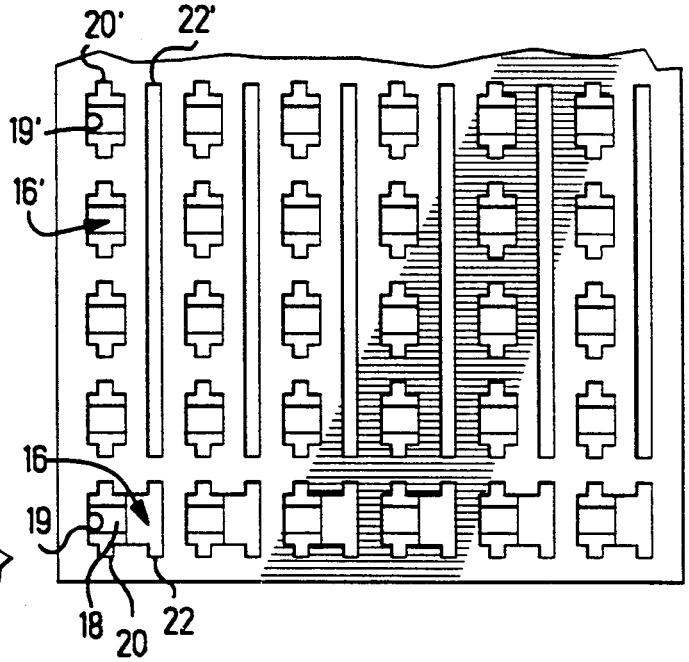
FIG. 9 is a rear view of the connector housing.

With reference to FIG. 9, which is a rear view of the housing member 4, the cross sectional configuration of the aperture 16 is shown in greater detail. The aperture 16 includes two vertical slots 20 and 22 where the first vertical slot 20 is symmetrical with the center of the narrow aperture 18 whereas the second vertical slot is flush with the right hand (as shown in FIG. 9) sidewall 17. It should be noted that the aperture 16, as defined by the sidewalls 17, 19 is asymmetrical with the center line of the narrow aperture 18, the reason for which, will be described in greater detail herein. The housing further comprises a plurality of apertures 16' which include vertical slots 20'. To the right of the apertures 20' are slots 22' which are vertically aligned with the vertical slots 22.

With reference again to FIG. 2, just below the top-wall 8 is located an elongate slot 24, which is defined by an upper surface 25, a lower surface 26 and sidewall surfaces 30. The upper surface 25 has a plurality of slots 34 therein for the receipt of keying members 274, and the lower surface 26 includes two raised sections 28, which will be described more fully herein.

Figure 8:
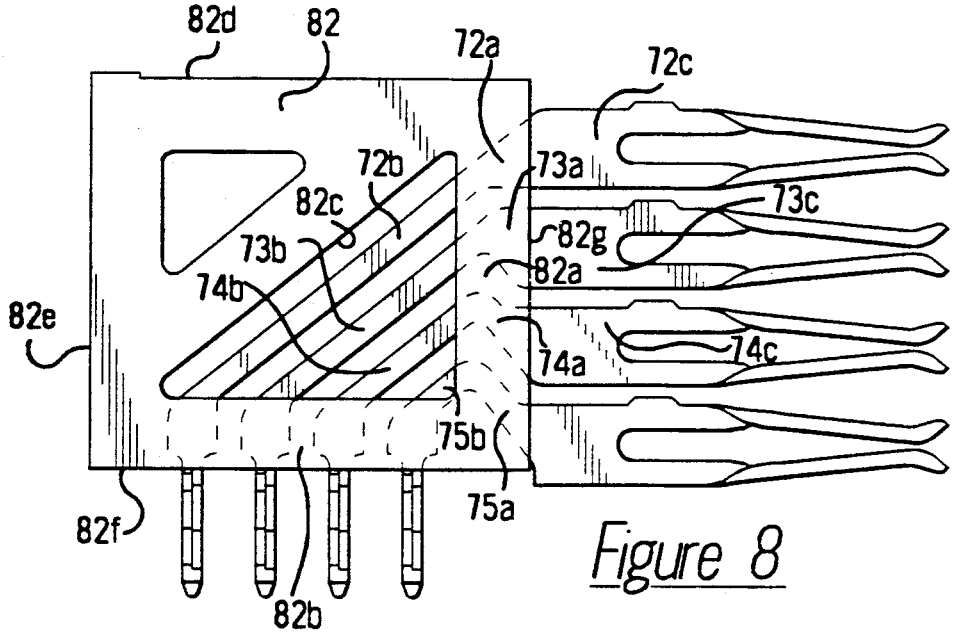
FIG. 8 is a view of the completed terminal subassembly.

The terminal subassembly 60, shown in FIG. 8 is manufactured by stamping a terminal lead frame 62, as shown in FIG. 6, having a plurality of individual terminal members 64, 65, 66 and 67. It should be noted that while the preferred embodiment is for use with 4 terminals, that is 64-67, an extra contact 67' commoned with contact 67 is available. Each of the terminals 64-67 include stamped contact portions 68, 69, 70 and 71. The contacts 64 through 67 also include intermediate sections 72, 73, 74 and 75 which interconnect the contact portions 68 through 71 to compliant pin sections 76 through 79 respectively.

Once the terminal lead frame is stamped, a web of insulating material 82 (FIG. 6) is molded over the terminal lead frame 62 such that one leg 82*a* spans and integrally retains, at least a portion of each of the intermediate portions, 72*a*, 73*a*, 74*a* and 75*a*. Items 72*a*-75*a* will be referred to as that portion of the intermediate portions 72-75 which is integrally molded within the insert 82. The molded web 82 also includes a leg 82*b* which is molded at a 90° angle relative to leg 82*a* and spans and integrally holds the plurality of terminals adjacent to the compliant pin sections 76-79. After the molding step, the terminals can be finished by having the terminal contact ends 68-71 formed into opposing contacts by twisting the contact arms amidst their length. The terminals can also be severed from their carrier strips to form discrete terminals. If only four terminals are required, then the lead frame will be severed at the dashed line 85 (FIG. 5) whereas the lead frame will be severed at the dashed line 87 if the extra contact is required.

By molding the legs 82*a* and 82*b* over the sections of the terminals, a window or opening 82*c* is formed over the terminal intermediate sections 72-75, which are not integrally molded in the web 82. It should be noticed first that the intermediate sections 72-75 are not equal in length, which is typical of any right angle connector. However, the configuration of the stamped terminals is an attempt to compensate for the difference in length of the intermediate sections. For example, terminal 72 has two bends which are approximately 45° angles, whereas terminal 75 has an intermediate bend, which projects the terminal downwardly which tends to lengthen the terminal. Thus the shape of terminal 72 tends to keep the propagation velocity high, whereas the shape of terminal 75 slows the propagation velocity; the end result of which is less time delay between the terminals. Thus, if the signal speed is equal in all of the terminals 64-67, a reflection would occur, and there would be a lag in the pulse signals in any two of the terminals 64-67, which could lead to a faulty switching signal, if two of the signals are being used in the same switching device.

To avoid the faulty signal switching, the terminals in the above mentioned application have equal impedance, or are "impedance matched". In the electrical connector of the instant invention, the configuration of the molded insert 82 has been designed to impedance match all of the electrical terminals.

It should be noticed that the lengths of the terminal sections 72*a*-75*a*, which is that section of the intermediate portion within the dielectric material, (FIG. 8) are of different lengths. For example, terminal section 75*a* has the longest length whereas terminal section 72*a* is the shortest. Conversely, those portions of the intermediate sections which are not within the molded web, 72*b*, 73*b*, 74*b*, and 75*b*, that is, that are open to the air medium, are inversely proportioned to its respective section 72*a*-75*a*. In other words, to look at the extremes, terminal 72 which is the longest of the terminals has the shortest section encapsulated within the dielectric (72*a*) yet the longest section (72*b*) which is within the air medium.

Terminal 75 however, which is the shortest of the terminals, has the longest section (75*a*) which is encapsulated within the dielectric and the shortest section (75*b*) which is within the air medium. Thus the impedance of terminal section 75*a* is greater than that of terminal section 72*a*. Terminal section 72*b* has an impedance which is different than terminal section 75*b*, due, primarily to its length. Since the air medium has a dielectric constant of 1.0 whereas the dielectric constant of the dielectric is much higher, on the order of 3.2, the increase in the length of the section 75*a* even a small distance, has a large effect on the overall impedance of that terminal, which also has a direct effect on the propagation velocity. Therefore, the impedance of the terminals 72–75 can be matched by controlling the length of the terminals in the various mediums, in this case within the dielectric and air.

It should also be noticed that the molded web 82 gives a generally rectangular shape having an upper horizontal surface 82*d*, a rear perpendicular surface 82*e*, a lower horizontal surface 82*f* and a forward perpendicular edge 82*g*.

With reference now to FIG. 1, the shield member 100 is shown as including an upper plate portion 102 having integral and resilient fingers 104 stamped and formed from the plate portion 102. It should be noticed that between each pair of fingers 104 is defined a slot 108. The shield member 100 further includes a rearwall 110 and a foot portion 112. Stamped from the rear wall, is a plurality of tab members 114 having apertures 116 therethrough.

To assemble the connector assembly, the plurality of terminal subassemblies 60 are inserted into the rear of the housing modules 4 such that the terminal subassemblies are each stacked one against the other as shown in FIGS. 1 and 2. The inserts 60, when stacked together, ensure that the blade sections 72*c*, 73*c*, 74*c* and 75*c*, are aligned with the vertical slot 20 which disposes the plurality of opposed contact portions 68–71 adjacent to the narrow aperture 18 at the front mating face of the connector. The terminal subassemblies 60 are inserted into the connector housing modules 4 until the front leading edge 82*g* of the molded web 82 abuts the rear face 14 of the connector housing module 4, as shown in FIG. 3. Due to the molded rear edge 82*e* the inserts 60 are easily inserted from the rear using conventional insertion tooling.

To assemble the shielded connector assembly, the plurality of terminal subassemblies 60 are inserted into the rear of the housing modules 4 between the plurality of rear spacer members 40. The inserts are inserted such that the blade portions 72*c*–75*c* (FIG. 8) are aligned with the vertical slot 20' which disposes the plurality of opposed contact portions 68–71 adjacent to the narrow aperture 18 at the front mating face of the connector. The terminal subassemblies 60 are inserted into the connector housing modules 4 until the front leading edge 82*g* of the molded web 82 abuts the rear face 14 of the connector housing module, as shown in FIG. 3.

It should be noted from FIG. 7, that the centerline of the terminal blank is molded off center relative to the molded insert. However, when the terminal subassemblies are inserted into the housing 4, the opposed contact portions 68–71 are aligned with the narrow apertures 18. This insert or subassembly 60 is used when crosstalk shielding between adjacent vertical rows of contacts is not necessary. In this application, the stackup thickness of the webs 80 aligns the terminals with the corresponding apertures.

Figure 12:
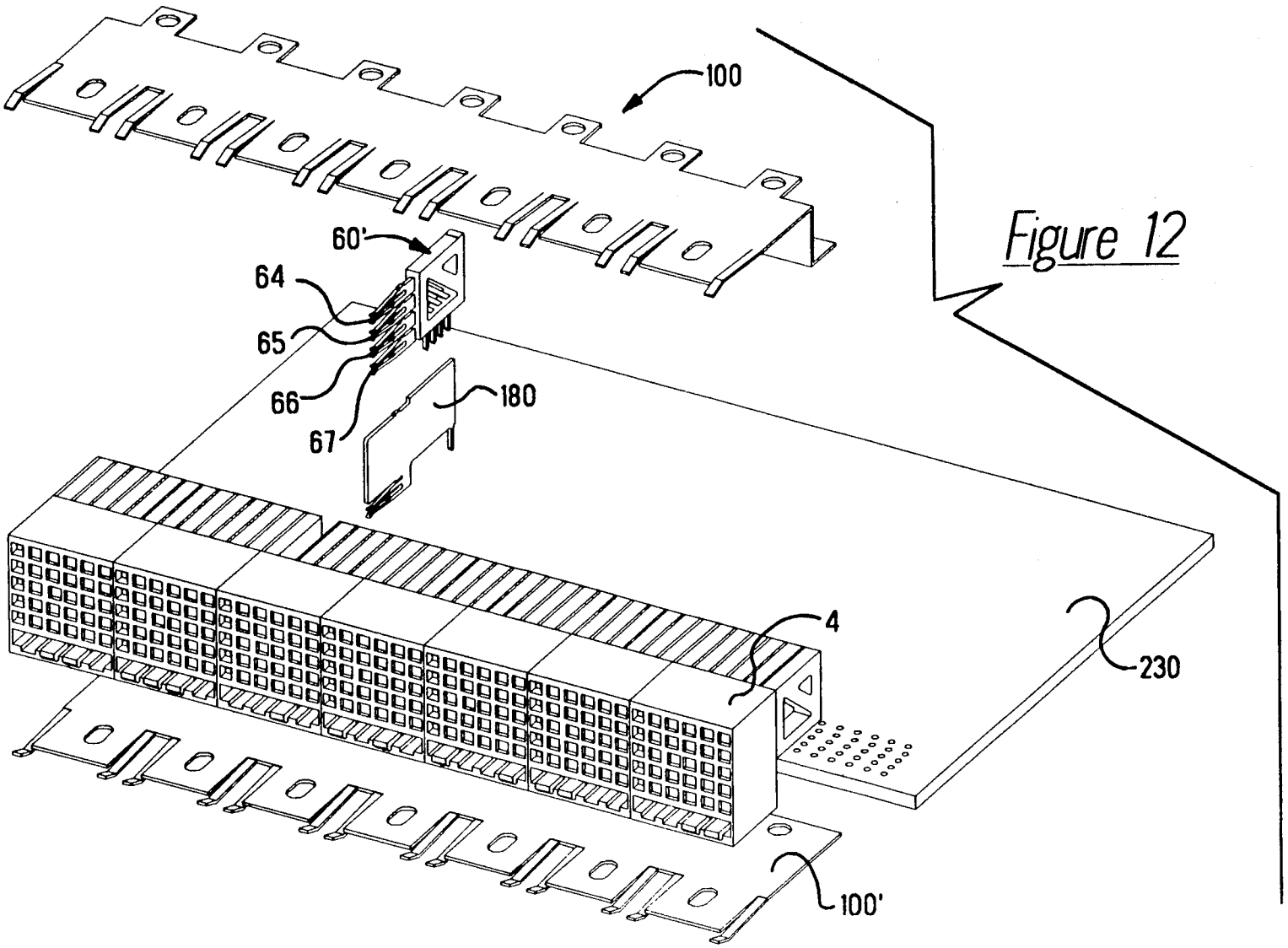
FIG. 12 is an isometric view showing the subject invention with the cross talk shield members in position for insertion.

In the event that crosstalk shielding is desired, then individual crosstalk shield members are available which are insertable between adjacent vertical rows of contacts. As shown in FIG. 12 and FIG. 13, cross talk shield members 180 are used in conjunction with terminal subassemblies 60', and are similarly placed within the housing modules.

As shown in FIG. 13, the shield member 180 includes a planar section 182 having a shielding plate 184 extending therefrom. A fifth contact member 185 is also included which is electrically connected to the ground member 180 has a staggered section 186 and an opposed contact section 188. Another staggered section 190 is included which has a compliant section 192 extending therefrom.

When the cross talk shield 180 is used, a different terminal subassembly is also used, and is designated as 60'. However, the only difference between the molded inserts 80 and 80' is the difference in their thickness. As shown in FIG. 13B, the thickness of insert 80' is less than that of insert 80, by the thickness of the crosstalk shield member 180. Said differently, the sum of the thickness of the molded insert 80' and the crosstalk shield member 180 is equal to the thickness of the molded insert 80.

When cross-talk shielding is used, the cross-talk shield 180 is inserted first, and then the terminal subassembly 60' is inserted into the housing module 4, the opposed contact sections still align with the narrow apertures 18, as the left justification has not changed. When the crosstalk shield member 180 is inserted into the module 4, the plate portion 184 of the shield member 180 resides within the respective vertical slot 22. At the lower horizontal row of contacts, the opposed contact sections 188 of shield 180 are stepped over, via the section 186, to align the opposed contacts 188 with the lower horizontal row of apertures 18. This allows the extra row of posts 266 (FIG. 10) to be used to ground the individual crosstalk shield members.

With the individual connector modules 4 assembled with terminal subassemblies 60, the housing modules and terminals can be inserted on a printed circuit board 200' such that the compliant pin sections 76-79 are inserted into the mating through holes 202', as shown in FIG. 12. It should be noticed that the section 190 also staggers the compliant pin 192 to the left to align it with the ground trace 204' on the printed circuit board 200'.

Figure 14:
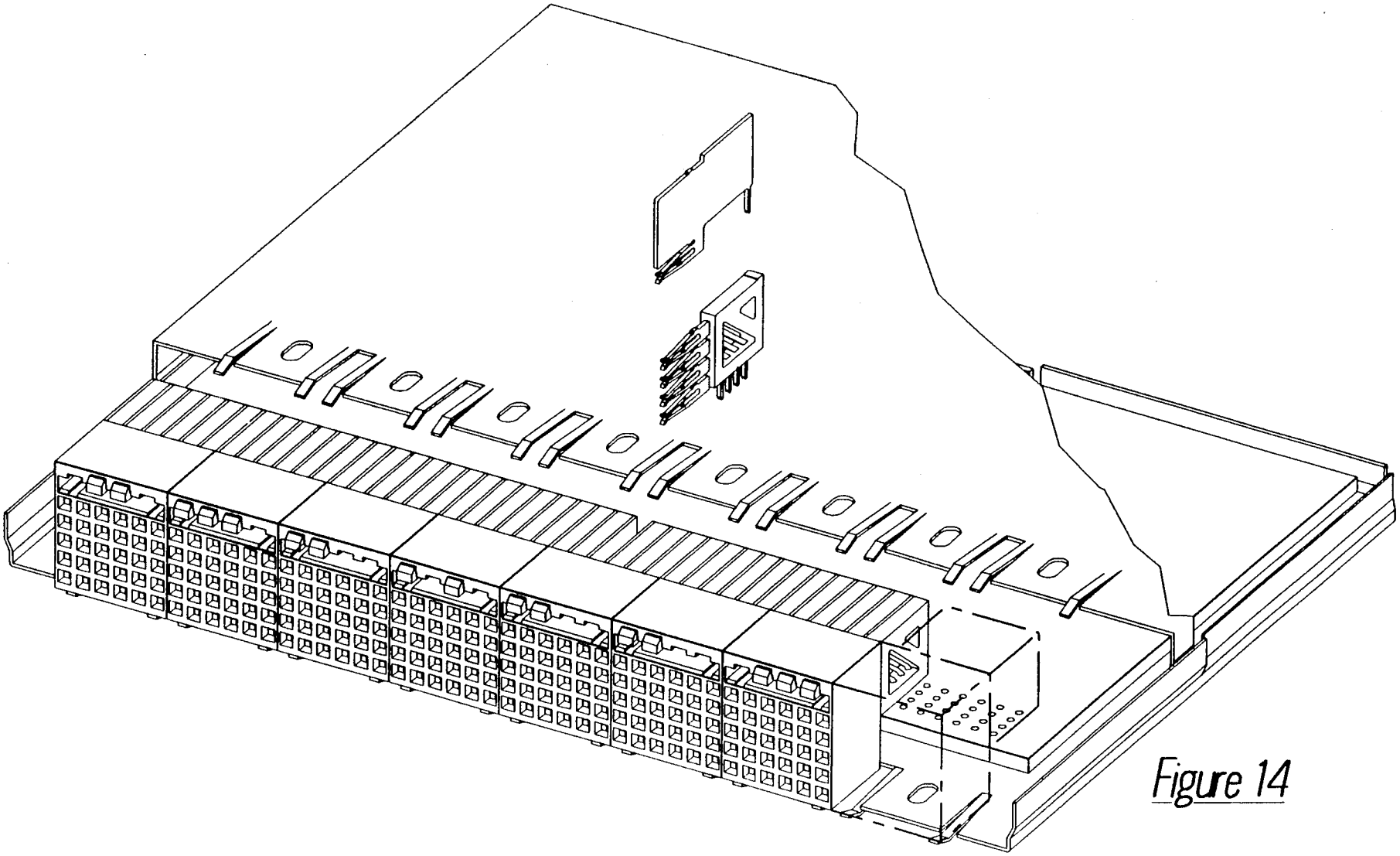
FIG. 14 is a further alternate embodiment of a fully shielded and enclosed daughterboard connector assembly.

With the connector modules so installed on a printed circuit board the shield and mechanical stiffener 100 may be assembled to the array of connector modules 4. The shield member 100 is inserted from the rear side of the connector assembly as shown in FIGS. 1, 12 or 14, such that the resilient fingers 104 of the shield are disposed between the inner surfaces 30 in the individual connector housing modules 4. This places tab portions 106 intermediate the elongate slots or channels 24. One upper shield member 100 would be used for the plurality of individual connector modules with two sheared strips or resilient fingers 104 dedicated to each singular connector module 4. As assembled, the fingers 104 flank the outside of the lug members 28 and the slots between the adjacent finger members 104 span the thin wall sections 32 of adjacent housing modules. One lower shield member 100' is also used as shown in FIG. 4 having resilient fingers 104'.

With reference now to FIG. 10, a backplane 230 is shown as including a plurality of through hole portions 230 in the backplane 230 with a plurality of post headers 260 stacked end to end electrically interconnected to the through hole sections 232. Each of the post headers 260 includes a housing 240 having a lower face 244 with the plurality of post through holes 242 therethrough. The post housing 240 further includes two sidewalls 246 and 248 where one of the sidewalls 246 includes slots 250. The post headers 260 further include a plurality of posts where the posts 262 are designated as the signal contacts, post 266 is an extra contact for use with either the extra contact 71' (FIG. 5), or with the crosstalk shield contacts 185 or 185' (FIGS. 12 and 14) and posts 270 are provided as an array of shielding members to shield the signal contacts from EMI/RFI.

Figure 4:
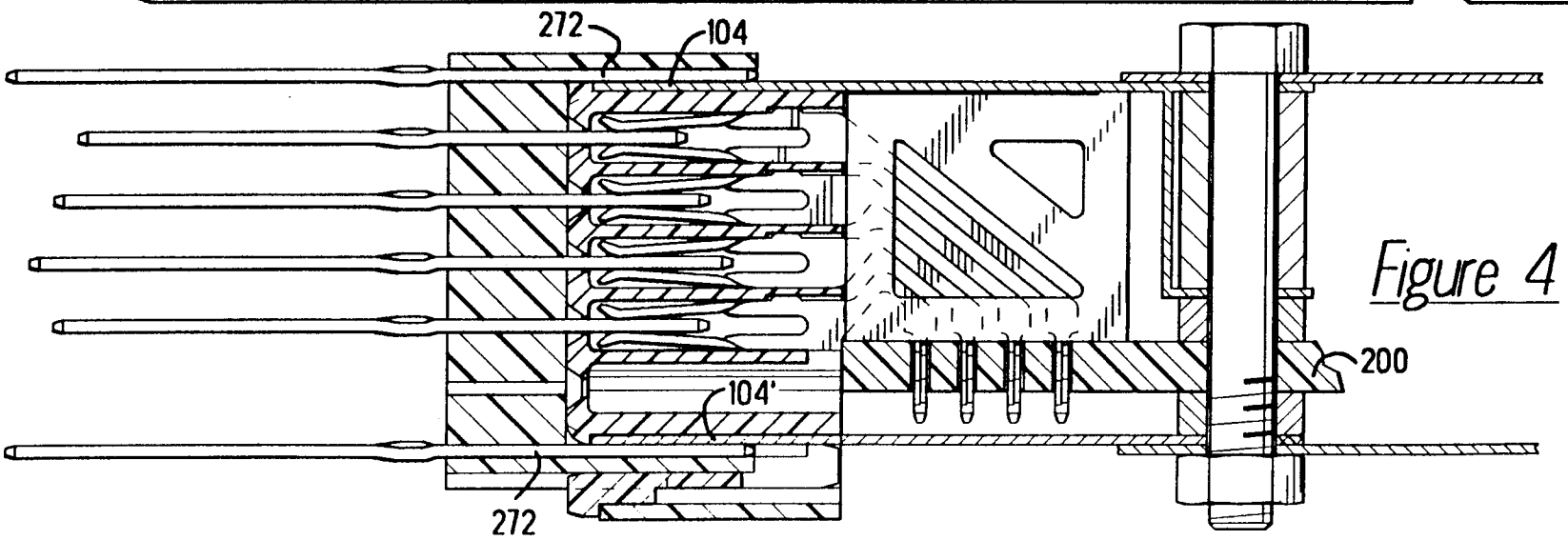
FIG. 4 is similar to FIG. 3 showing the daughterboard connector and post header in a mated configuration.

When the shielded connector assembly 2 is to be interconnected to the post headers as shown in FIG. 4, the connector housing modules 4 and the post header housings 240 can be keyed together to form a unique polarized interconnection system. For example, in the configuration shown in FIG. 10, the assembly is shown as including seven post headers 260 assembled to the motherboard 230. In the first of the post headers 260 on the motherboard 230, the first two slots 250 are left blank while the last two slots include polarizing lugs 274. In the second post housing the first two slots 250 include two polarizing lugs 274 while the last two slots are left free. To key the housing modules 4 to mate with the first of the two tab housings shown in FIG. 1, in the first housing module 4 the first two slots 34 would include keyed members 274 while in the second module 4 the last two slots would include keying lugs 274. Therefore, when the shielded subassembly 2 as shown in FIG. 1 is interconnected to the plurality of post headers as shown in FIG. 10, the first two keying lugs 274 in the first housing module 4 would pass within the first two slots 250 in the first tab header while the keying lugs 274 in the last two slots 250 would pass within these slots 34 in the first housing module 4.

The preferred method for assembling the connector system is to have the aperture 24 (FIG. 2) on the bottom as shown best in FIG. 12. This provides that the upper shield member 100 can be placed straight down onto the top of the connector assembly. In the event that a plurality of components are placed on the board, there may not be enough room for the shield member 100 to be slid into place from the rear. Shield member 100' should be able to be slid into place as the underside of the board 230 should be clear.

This polarizing scheme would be carried out throughout the assembly to provide any multiple of keyed systems. It should also be noticed that when the shielded interconnection system 2 is interconnected to the plurality of tab headers as shown in FIG. 4, the wall 246 is within the opening 24 of the individual housing modules. Each of the tab housings 240 includes a recessed section 252 at both ends of the wall 246, when the tab housings are abutted one to the other a slot 254 is formed which allows the adjacent walls 32 of the modules 4 to pass therein. It should also be noticed that when in this position, the two fingers 104 are interconnected to the ground posts 270 which are in the corner positions only. The remainder of the contacts 270 intermediate the corner posts do not contact the shield member 102 but only act as shielding for the interior signal contacts.

FIG. 14 is an alternate embodiment of any of the previous connector systems where the entire connector assembly is shielded.

Figure 15:
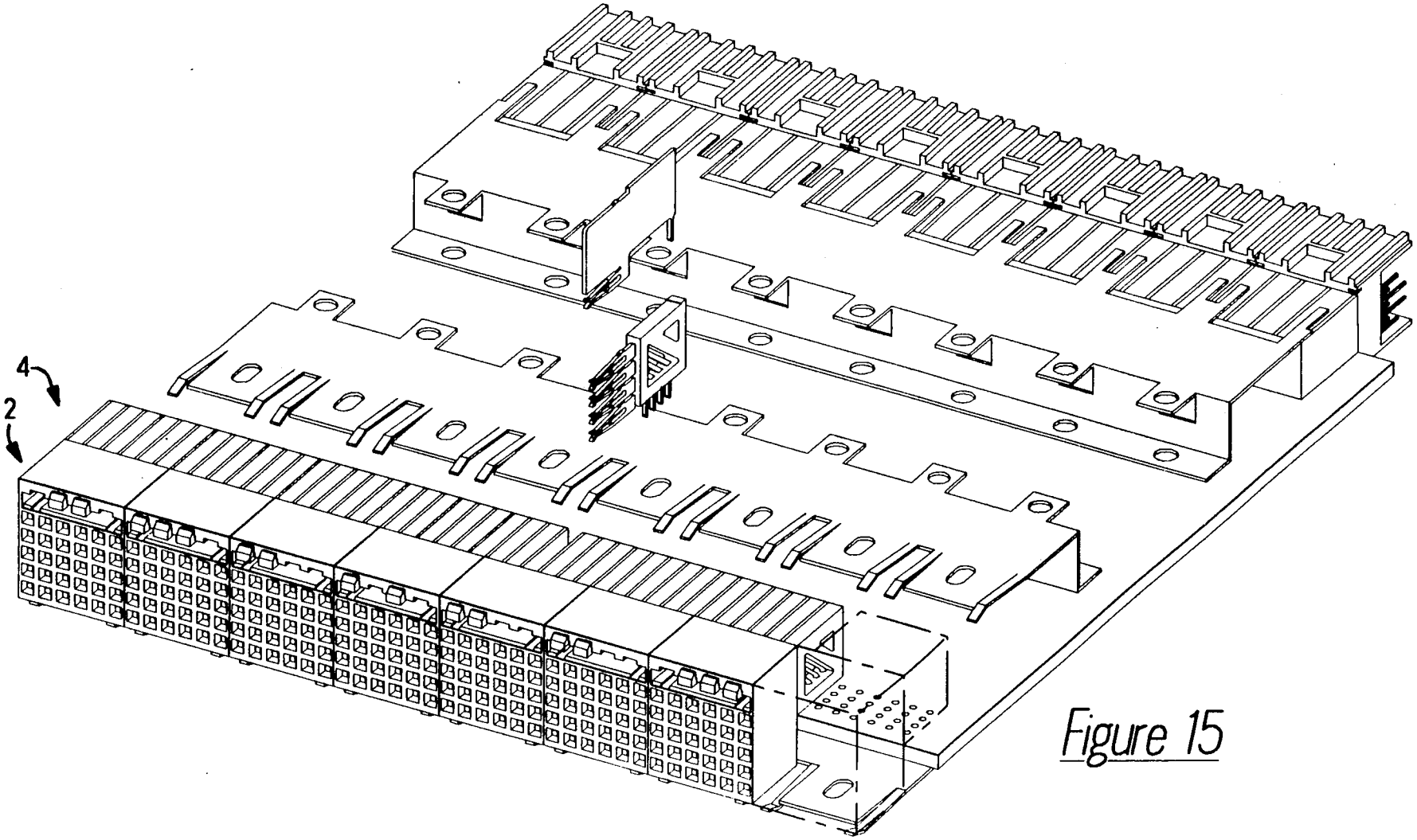
FIG. 15 is a further embodiment of the above mentioned application.

FIG. 15 is an alternate embodiment shown the possibility for further expansions to the system, where another post header is added to the daughter board and can accept a further daughterboard connector therein.

Figures 16, 17:
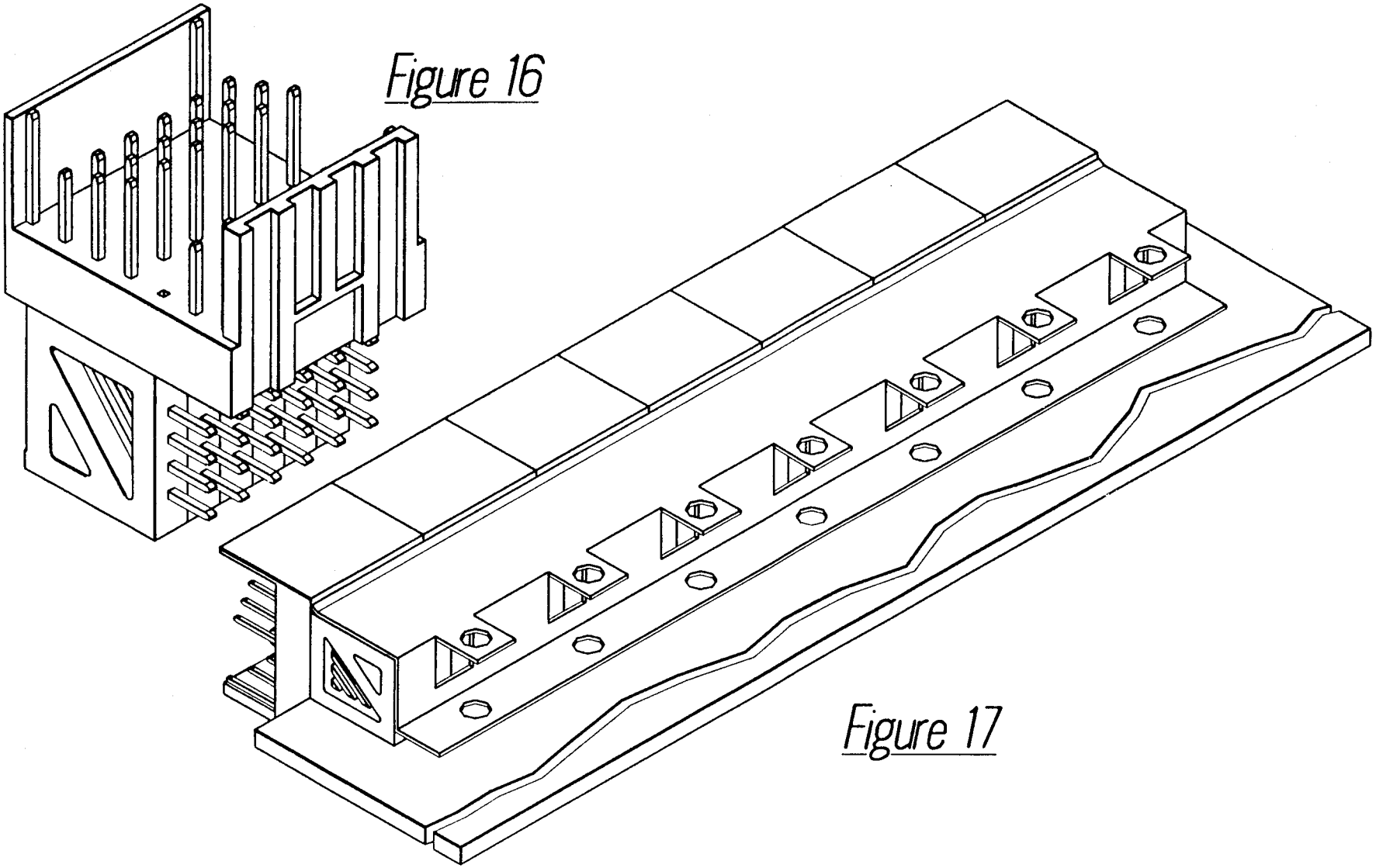
FIG. 16 is a right angled post header for use with the embodiment of FIG. 15.
FIG. 17 is a rear isometric view of the portion of the connector shown in FIG. 16.

FIG. 16 is an isometric view of the tab header for use in the connection system of FIG. 15.

FIG. 17 is a rear view of that portion of the connector assembly of the FIG. 16.

I claim:

1. A controlled impedance right angle electrical connector assembly (2) comprising:

an insulating housing (2) having a front mating face (6) and a rear face (14), said housing a plurality of terminal receiving passageways, with the passageways arranged in an array of columns and rows; and at least one terminal module (60,60') where the module (60,60') comprises:

(a) a stamped lead frame (62) including a plurality of edge stamped right angle contacts (64,65,66,67,67') where the contacts each include a printed circuit board interconnection section (76,77,78,79), an intermediate section (72,73,74,75) and a mating contact section (68,69,70,71,71'); each consecutive intermediate section (72,73,74,75) increasing in length from the prior and adjacent contact, and (b) an overmolded insert (82) discrete from the housing which encapsulates at least a portion of each intermediate section (72,73,74,75) in an insulative material leaving the remainder of each intermediate section (72,73,74,75) exposed to the air, the length of each intermediate section encapsulated within the insert decreasing as the intermediate portions increase in length, thereby balancing the impedance of the plurality of contacts.

2. The connector of claim 1 wherein each intermediate section (72,73,74,75) extends at a designated angle between the respective printed circuit board interconnection section (76,77,78,79) and mating contact section (68,69,70,71,71').

3. The connector of claim 2 wherein the overmolded insert (82) includes a first leg (**82*b*) which spans each intermediate section (72,73,74,75) adjacent to the respective printed circuit board interconnection section (76,77,78,79**).

4. The connector of claim 3 wherein the over molded insert (82) includes a second leg (**82*a*) portion which spans each intermediate sections (72,73,74,75) adjacent to the respective mating contact section (68,69,70,71**).

5. The connector of claim 4 wherein the length of each intermediate section (72,73,74,75) within the second leg portion (**82*a*) varies with the respective contact (64,65,66,67,67'**).

6. The connector of claim 1 wherein the modules (60,60') are abuttable against the housing (4) with the mating contact sections extending through the rear face (14) and positioned within the passageways.

7. The connector of claim 6 wherein the modules (60) are dimensioned to stack one against the other, to align the mating contact sections (68,69,70,71,71') with the passageways, and with pin receiving openings (16a–16e).

8. The connector of claim 6 wherein the modules (60') include between them a planar shield member (180').

9. The connector of claim 8 wherein the modules (60') and the shield members (180') are dimensioned to stack one against the other, to align the mating contact sections (68,69,70,71,71') with the pin receiving openings (16a–16e).

10. An impedance matched electrical connector, comprising:

an insulative housing means having a front mating face and a rear face, a plurality of terminal receiving passageways extending between said faces forming an array of columns and rows of passageways, a plurality of vertically oriented modules each having electrical terminals integrally molded within an insulative web, said terminals having mating contact portions extending in a generally horizontal direction and being adapted for receipt within a said column of terminal receiving passageways and positioned adjacent to said front mating face, said terminals further comprising printed circuit contact portions being disposed at substantially a right angle relative to said mating contact portions, said terminals further comprising intermediate portions interconnecting said contact portions and said printed circuit contact portions, each consecutive intermediate portion being progressively longer in length, said web encapsulating a length of each intermediate portion by an amount inversely proportionate to lengths of said intermediate portions, thereby balancing the impedance in the terminals.

11. The electrical connector of claim 10, wherein said web is formed at least in part by a horizontal leg section encapsulating said intermediate contact portions adjacent to said printed circuit contact portions.

12. The electrical connector of claim 11, wherein said web further comprises a vertical leg section encapsulating said intermediate contact portions adjacent to said mating contact portions.

13. The electrical connector of claim 10, wherein said terminals are edge stamped to lie in a substantially vertical plane, and said mating contact portions are bent about said vertical plane to form opposed contact arms lying in parallel horizontal planes, said web encapsulating said terminals asymmetrically to position said opposed contact arms along a centerline of said web.

14. The electrical connector of claim 13, wherein said web is dimensioned to stack against other webs of said plurality of modules with the opposed contact arms being spaced apart a distance equal to the centerline spacing between adjacent passageways.

15. The electrical connector of claim 13, wherein said webs are dimensioned to receive between them, a ground plane while the opposed contact arms are spaced apart a distance equal to the centerline spacing between adjacent passageways.

16. The electrical connector of claim 15, wherein each of ground plane includes a contact portion positioned in a ground terminal receiving passageway in said housing.

17. The electrical connector of claim 16, wherein said ground terminal receiving passageway is aligned with said column of terminal receiving passageways, and said ground contact portion is laterally staggered for alignment with said ground terminal receiving passageway.

18. The electrical connector of claim 17, wherein said housing includes a slot parallel to each said column of terminal receiving passageways, and said ground plane includes a plate section positioned in said slot and extending to a position proximate the mating face.

19. The electrical connector of claim 18, wherein said ground plane includes a printed circuit board contact leg, shared from a rear portion of said plate portion, and laterally staggered to be aligned with said printed circuit contact portions in an adjacent module.

20. An electrical connector, comprising:

a plurality of individual housing modules each having a front mating face and a rear face, top and bottom walls and sidewalls, said housing modules each including terminal receiving passageways extending between said faces, said housing modules further comprising an elongate channel extending horizontally across and between an exterior row of said passageways and said top wall, said plurality of said housing modules in an abutting relation with sidewalls of adjacent modules being positioned one against the other;

a plurality of electrical terminals positioned in said housing, disposed in said passageways; and a first one-piece electrical shield member attached to said plurality of modules, said shield member including a plurality of slots thereby forming intermediate tab portions, said slots being located relative to said abutting housings to flank said abutting sidewalls forming said elongate channels and position said tab portions in said elongate channels.

21. The electrical connector of claim 20, wherein said first shield member includes sheared strips flanking said tab portions, said sheared strips forming resilient ground contact portions.

22. The electrical connector of claim 21, further comprising a shield member on an opposite side as said first shield member, substantially enclosing said housing modules.

23. The electrical connector of claim 22, wherein said two shield members are commoned together.

24. An electrical connector assembly, comprising:

a receptacle assembly comprising a plurality of individual housing modules each having a front mating face and a rear face, top and bottom walls and sidewalls, said housing modules each including terminal receiving passageways extending between said faces, said housing modules further comprising an elongate channel extending horizontally across and between an exterior row of said passageways and said top wall, thereby forming thin sidewall sections at opposite ends of said channel, a plurality of said housing modules being positioned in abutting relation with sidewalls of adjacent modules positioned one against the other; a plurality of electrical terminals positioned in said housing, disposed in said passageways with receptacle contact portions positioned adjacent to said mating face; and a post header comprising an insulative housing, having sidewalls extending generally parallel to a length of said receptacle assembly, one of said post header sidewalls having a plurality of spaced slots adapted to receive therein said abutted thin sidewall sections of the receptacle assembly formed by said channels, and said elongate channels are adapted to receive therein a portion of said one post header sidewall intermediate adjacent slots, said header further comprising a plurality of upstanding posts positioned in an array matching said passageways through said mating face.

25. The assembly of claim 24, wherein said header housing is comprised of individual housing modules, substantially the same length as said receptacle housing modules, and each end of said one post header sidewall includes notched recessed portions forming said slots when end abutted with a like housing.

26. The assembly of claim 25, wherein an upper inside surface of said channel includes polarizing lugs, whereas an outer surface of said one post header sidewall includes recessed grooves profiled to accept said lugs, said lugs and recessed grooves uniquely keying said receptacle to said post header.

27. The assembly of claim 26, wherein said lugs are removable and replaceable in alternate lateral locations.

28. The assembly of claim 24, further comprising a first one-piece electrical shield member attached to said plurality of modules, said shield member having a plurality of slots along a front edge thereof, thereby forming tab portions, said shield member slots being located relative to said abutting housings to flank said abutting thin sidewall sections and position said tab portions in said elongate channels.

29. The electrical connector of claim 28, wherein said first shield member includes sheared strips flanking said tab portions, said sheared strips forming resilient ground contact portions, and said post header includes grounding posts adjacent to an inner surface of said one post header sidewall, and aligned with said resilient ground contact portions.

30. The electrical connector of claim 29, further comprising a second shield member on an opposite side as said first shield member, substantially enclosing said housing modules.

31. The electrical connector of claim 30, wherein said second shield member includes resilient ground contact portions, and said tab header includes posts adjacent to an inner surface of the post header sidewall opposite to the one said sidewall.

32. An electrical connector assembly, comprising:

a receptacle assembly comprising an insulative housing having a front mating face and a rear face, top and bottom walls and sidewalls, said housing having terminal receiving passageways extending between said faces, said housing further comprising an elongate channel extending horizontally across and between an exterior row of said passageways and said top wall; a plurality of electrical terminals positioned in said housing, disposed in said passageways with receptacle contact portions positioned adjacent to said mating face; and a first onepiece electrical shield member attached to said housing, being receivable in said elongate channel, said shield member including resilient ground contact sections integrally formed in said shield member and positioned at opposite ends of said channel; and a post header comprising an insulative housing, having sidewalls extending generally parallel to a length of said receptacle assembly, said header comprising a plurality of upstanding posts positioned in an array matching said passageways through said mating face, and ground posts positioned at ends of said header housing adjacent to an inner surface of one of said post header sidewalls.

33. The electrical connector of claim 32, wherein a plurality of receptacle housings are abutted one to the other, and a plurality of header housings are abutted one to the other.

34. The electrical connector of claim 33, wherein said channel forms thin sidewall sections at opposite ends of said housing, and said shield member includes slots intermediate adjacent ground contact sections, said slots spanning pairs of said thin sidewall sections of abutted housings.

35. The assembly of claim 34, wherein said header housing is comprised of individual housing modules, substantially the same length of said receptacle housing modules, and each end of said one post header sidewall includes notched recessed portions forming slots when end abutted with a like housing.

36. The assembly of claim 35, wherein an upper inside surface of said channel includes polarizing lugs, whereas an outer surface of said one sidewall includes recessed grooves profiled to accept said lugs, said lugs and recessed grooves uniquely keying said receptacle to said post header.

* * * * *

UNITED STATES PATENT AND TRADEMARK OFFICE

CERTIFICATE OF CORRECTION

PATENT NO. : 5,066,236

DATED : November 19, 1991

INVENTOR(S) : Johannes M. Broeksteeg

It is certified that error appears in the above-identified patent and that said Letters Patent is hereby corrected as shown below:

Claim 1, column 8, line 17 - delete "(2)" and insert --(4)--.

Claim 1, column 8, line 19 - After the word "housing", insert --having--.

Signed and Sealed this

Thirteenth Day of July, 1993

*Attest:*

Michael K. Kirk

MICHAEL K. KIRK

*Attesting Officer*

*Acting Commissioner of Patents and Trademarks*